US006710752B2

(12) United States Patent
Saito et al.

(10) Patent No.: US 6,710,752 B2
(45) Date of Patent: Mar. 23, 2004

(54) HELICAL ANTENNA

(75) Inventors: Tetsuya Saito, Kodama-gun (JP); Makoto Yamaguchi, Fuchu (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/157,054

(22) Filed: May 30, 2002

(65) Prior Publication Data

US 2003/0058186 A1 Mar. 27, 2003

(30) Foreign Application Priority Data

May 31, 2001 (JP) ..... 2001-164659

(51) Int. Cl.[7] ..... H01Q 1/36
(52) U.S. Cl. ..... 343/895; 343/702
(58) Field of Search ..... 343/895, 702, 343/725, 790, 866, 700 MS

(56) References Cited

U.S. PATENT DOCUMENTS 5,990,848 A * 11/1999 Annamaa et al. ..... 343/895
6,111,545 A 8/2000 Saari ..... 343/702
6,112,102 A 8/2000 Zhinong ..... 455/550
6,124,831 A * 9/2000 Rutkowski et al. .. 343/700 MS
6,320,545 B1 * 11/2001 Nagumo et al. ..... 343/700 MS
6,340,954 B1 * 1/2002 Annamaa et al. ..... 343/895

FOREIGN PATENT DOCUMENTS

EP 0 747 989 A 12/1996
EP 0 987 788 A 3/2000

* cited by examiner

*Primary Examiner*—James Clinger
(74) *Attorney, Agent, or Firm*—Sughrue Mion, PLLC

(57) ABSTRACT

In a helical antenna operable at a plurality of frequencies, a radiation element includes a first pitch portion which is connected to a feeding point and in which the electric conductor is wound around or folded back at a first pitch, and a second pitch portion which is connected to the first pitch portion and in which the electric conductor is wound around or folded back at a second pitch different from the first pitch. A tip end stab element extended from the tip end of the radiation element is placed in close proximity of the radiation element. The radiation element and the tip end element form frequency selection means or a parallel resonant circuit at an intermediate point of the radiation element.

10 Claims, 9 Drawing Sheets

HELICAL ANTENNA

BACKGROUND OF THE INVENTION

1. Field of the Invention

The present invention relates to a helical antenna, and more particularly to characteristic improvement of a helical antenna which resonates at a plurality of frequencies.

2. Description of the Related Art

A portable radio apparatus is provided with an antenna at a top of a case, and by means of the antenna, a radio wave is radiated and caught to perform transmission-reception operation. Some portable telephone is provided with a helical antenna in which a protrusion amount of the antenna from the case is reduced. Other portable radio apparatus in recent years correspond to a plurality of radio communication systems, and therefore the antenna needs to have the characteristic of resonating in a plurality of frequency bands.

Consequently, as shown in FIG. 1, a helical antenna in which wire windings with different winding pitches are connected in series and placed at a top and bottom is proposed. In this helical antenna, conductive wire 3 wound around is housed in case 5 and feeder line 4 is drawn out of a lower end of case 5. In case 5, conductive wire 3 wound around forms wide pitch portion 7 at a lower side from pitch changing portion 6 and forms narrow pitch portion 8 at an upper side. The helical antenna has two resonant frequencies, that is, a first resonant frequency ($f_L$) and a second resonant frequency ($f_H$), which is higher than the first resonant frequency ($f_L$).

An equivalent circuit of the conventional antenna will be described with reference to FIGS. 2A and 2B. FIG. 2A shows a schematic view of the conventional helical antenna, and FIG. 2B shows the equivalent circuit thereof.

Wide pitch portion 7 and narrow pitch portion 8 of the helical antenna constitute a rod antenna. Since adjacent conductive wires (windings) 3 are placed in close proximity in narrow pitch portion 8, a capacitor is formed between winding wires 3. Therefore, parallel resonant circuit 12 which is the result of connecting the capacitor and an inductance by the winding in parallel is formed near pitch changing portion 6 at which wide pitch portion 7 and narrow pitch portion 8 are switched, and this works as a trap for selectively passing or blocking a specified frequency. This parallel resonant circuit 12 is constructed to resonate at a second resonance frequency ($f_H$). Thus, the parallel resonant circuit 12 has high impedance at the second resonance frequency ($f_H$), and resonates at wide pitch portion 7 at a lower side from pitch changing portion 6. On the other hand, parallel resonant circuit 12 has low impedance at the first resonance frequency ($f_L$), and resonates in the total length of wide pitch portion 7 and narrow pitch portion 8. As described above, an antenna tuning to two frequencies ($f_L$, $f_H$) is formed by the action of parallel resonant circuit 12 formed at narrow pitch portion 8.

FIG. 3 shows the frequency characteristic of a voltage standing wave ratio (VSWR) in the conventional helical antenna shown in FIG. 1. In this helical antenna, resonance occurs at a frequency ($f_L$) near 900 MHz and a frequency ($f_H$) near 1800 MHz, and transmission and reception of the radio waves can be made at two frequencies.

In the conventional helical antenna, a winding pitch and the number of windings are changed to adjust the characteristic of an antenna. For example, if the winding pitch is widened, the band width at the resonance frequency is widened, but if the winding pitch is changed without changing the entire length of the antenna, the number of windings is changed and a electric length of the antenna element (radiation element) is changed, thus changing the resonance frequency.

In concrete, the winding pitch in the narrow pitch portion is uniquely determined by the condition to form a capacitance component with which the parallel resonant circuit resonates at the second resonance frequency ($f_H$) Thus, it is difficult to change parameters (the winding pitch, the number of windings) in the narrow pitch portion while the second resonance frequency ($f_H$) and the resonance frequency of the parallel resonant circuit 12 are kept constant. Namely, even if the characteristics of the antenna is to be improved at the first resonance frequency ($f_L$), the degree of freedom of electrical design of the antenna at the first resonance frequency ($f_L$) is small, and there is the problem that improvement of the antenna characteristics such as VSWR, band width, radiation efficiency and the like at the first resonance frequency ($f_L$) is difficult.

If the characteristics of the antenna are designed to improve without especially changing the outer dimension (total length) and the resonance frequency of the antenna, the winding pitches in wide pitch portion 7 and narrow pitch portion 8 change in relation to each other, and therefore the resonance frequency of parallel resonant circuit 12 cannot be changed. In other words, the design of the winding pitch of narrow pitch portion 8, the number of windings and the like cannot be changed. Therefore, it is difficult to improve the antenna characteristics.

SUMMARY OF THE INVENTION

The object of the present invention is to provide a helical antenna which facilitates the improvement of the antenna characteristics in the helical antenna having a plurality of resonance frequency.

The object of the present invention is achieved by a helical antenna comprising: a radiation element which is formed by winding or folding back an electric conductor; and a tip end element which is extended from the radiation element and placed in close proximity of the radiation element; the radiation element comprising: a first pitch portion which is connected to an feeding point and in which the electric conductor is wound around or folded back at a first winding pitch, and a second pitch portion which is connected to the first pitch portion and in which the electric conductor is wound around or folded back at a second winding pitch different from the first winding pitch.

In this helical antenna, the second pitch portion and the tip end element form a capacitance component (capacitor) to form frequency selection means at an intermediate portion of the radiation element, thus facilitating improvement in the antenna characteristics for each of a plurality of resonance frequencies.

The object of the present invention is also achieved by a helical antenna comprising: a radiation element which is formed by winding or folding back an electric conductor; said radiation element comprising: a first pitch portion which is connected to a feeding point and in which the electric conductor is wound around or folded back at a first winding pitch; a second pitch portion which is connected to the first pitch portion and in which the electric conductor is wound around or folded back at a second winding pitch narrower than the first pitch; and a third pitch portion which is connected to the second pitch portion and in which the electric conductor is wound around or folded back at a third winding pitch wider than the second winding pitch.

In this helical antenna, a capacitance component (capacitor) is formed by the second pitch portion to form frequency selection means, and at the low resonance frequency, the third pitch portion functions as an radiation element, thus facilitating improvement of the antenna characteristics for each of a plurality of resonance frequencies.

The above and other objects, features, and advantages of the present invention will become apparent from the following description with reference to the accompanying drawings which illustrate an example of the present invention.

DETAILED DESCRIPTION OF THE INVENTION

Figure 4:
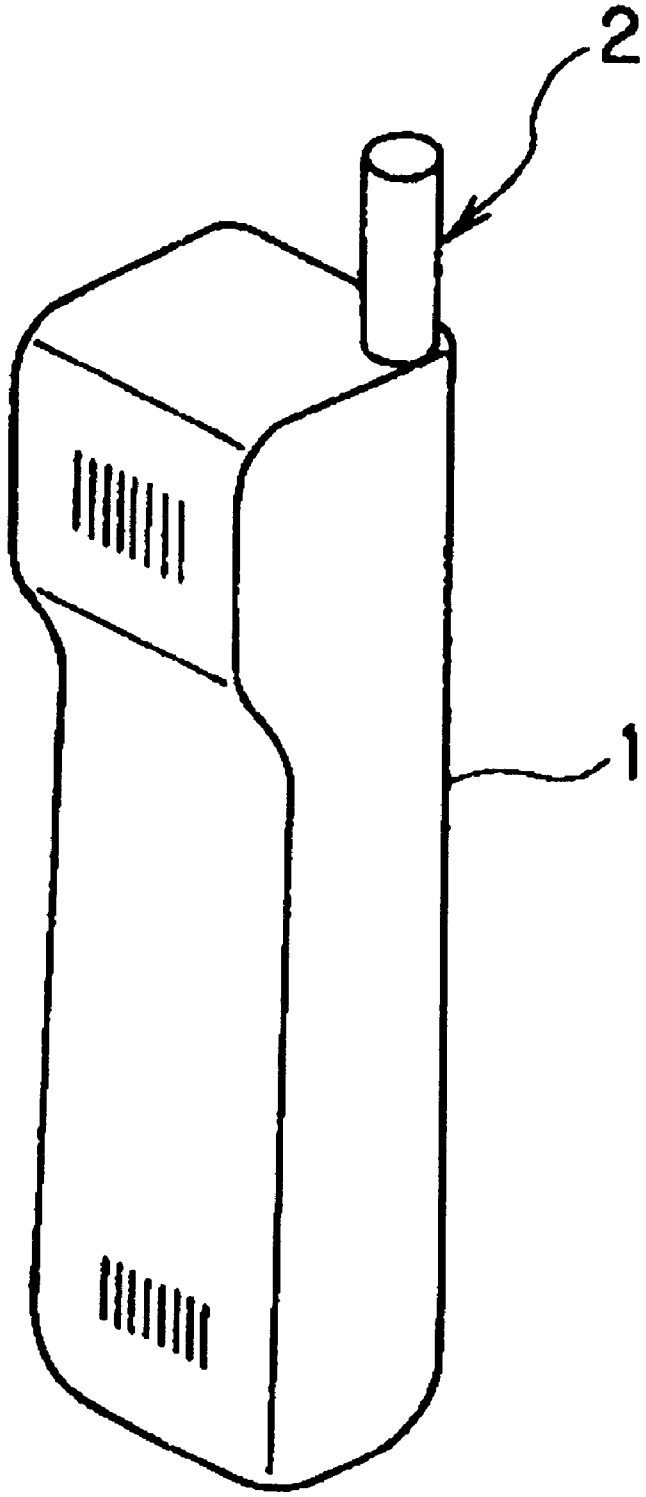
FIG. 4 is a perspective view showing an arrangement of an antenna according to the present invention in a portable radio apparatus.

FIG. 4 shows an arrangement of an antenna of the present invention which is incorporated within a portable radio apparatus. The portable radio apparatus radiates a radio wave from helical antenna 2 which is provided to project from a top of case 1, catches the radio wave at helical antenna 2, and performs a transmission-reception operation. A feeding portion of this helical antenna 2 is connected to a transmission-reception portion (not shown) provided inside case 1 and supplied with a radio frequency signal from the transmission-reception portion.

Figure 5:
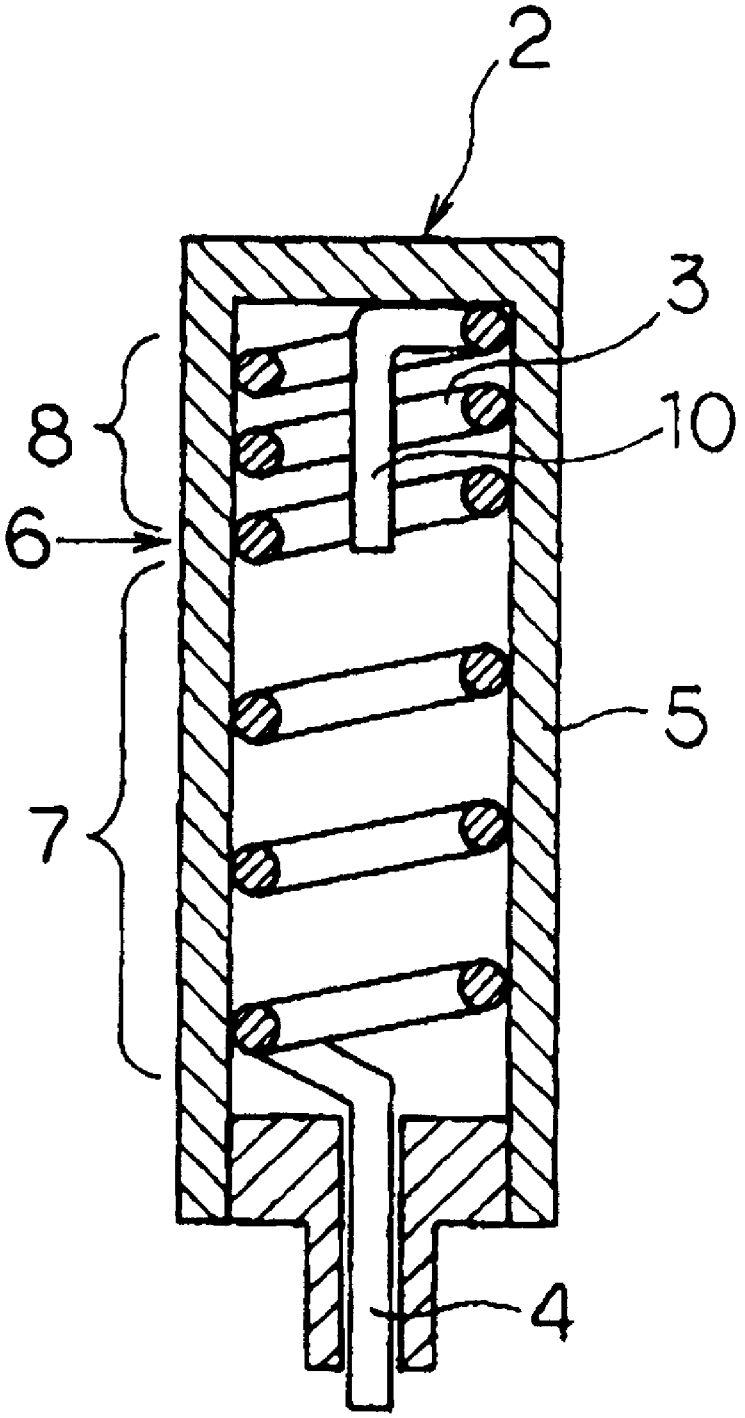
FIG. 5 is a sectional view of a helical antenna according to a first embodiment of the present invention.

As shown in FIG. 5, the helical antenna of the first embodiment is constructed so that elements composed of winding wire portions 7 and 8 with different winding pitches are connected in series and placed vertically and tip end stab element 10 extended from a tip end of the winding wire is hung at a center part of the winding and placed at a position in close proximity to the winding wire.

In helical antenna 2, conductive wire 3 wound around is housed in case 5 and a tail end of conductive wire 3 is drawn out as a feeding wire 4 from a lower end of case 5. Inside case 5, conductive wire 3 is wound around at a predetermined first winding pitch inside case 5, the winding pitch is changed at pitch changing portion 6, and is further wound around at the second winding pitch narrower than the first winding pitch. Consequently, the conductive wire 3 wound around forms a wide pitch portion 7 at the lower side from the pitch conversion portion 6 and a narrow pitch portion 8 at the upper side from the pitch conversion portion 6. Moreover, tip end stab element 10 is extended from the top portion of narrow pitch portion 8. Tip end stab element 10 is folded back in a center direction of the winding, hung inside the winding and extended downward, that is, in the direction of feeding wire 4, to an area near pitch changing portion 6.

Case 5 is formed of resin, and is attached to housing 1 of the portable radio apparatus at a portion near the leader portion of feeding wire 4. Feeding wire 4 drawn out of case 5 extends into housing 1 of the portable radio apparatus and connected to the transmission-reception portion of the portable radio apparatus.

The inside of case 5 may be hollow or filled with resin. If resin is filled inside case 5, it never happens that winding wires 7 and 8 and tip end stab element 10 move, and the resonance frequency and the frequency characteristic do not change.

As an antenna to which the first embodiment of the present invention is applied, a concrete constitution of the helical antenna for dual band operation at bands of 900 MHz and 1800 MHz will be explained below. The helical antenna is constituted so that narrow pitch portion 8 located near the tip end of the antenna has about three winding turns of a winding pitch of about 1 mm (about 0.003 times to a wavelength of a low resonance frequency), and wide pitch portion 7 located near the feeding point of the antenna has about two turns of winding pitch of about 5 mm (about 0.016 times to a wavelength of a low resonance frequency, about five times to the winding pitch of the narrow pitch portion). Namely, pitch changing portion 6 is provided at the position of about one forth from the tip end of the antenna in the total length of the antenna element (radiation element). Further, tip end stab element 10 is folded back in the center direction of the winding from the tip end of the antenna and extended by about 5 mm inside the winding.

Figure 6A:
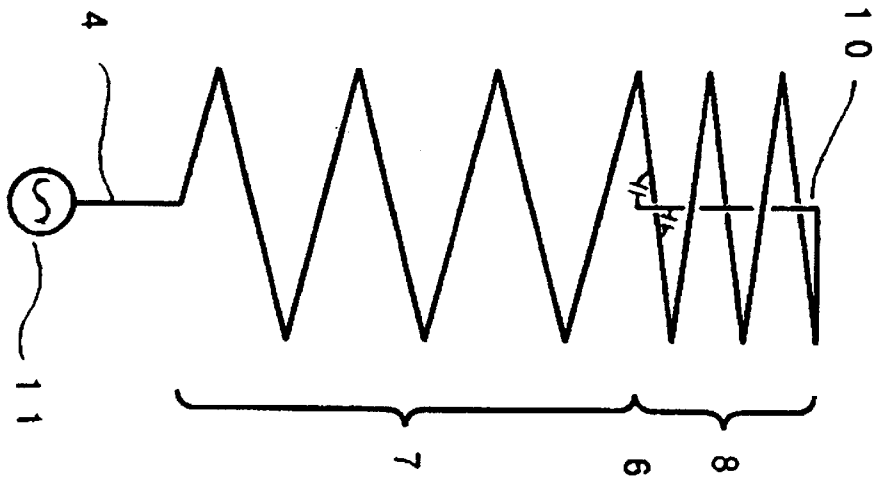
FIG. 6A is a schematic view of the helical antenna of the first embodiment.
Figure 6B:
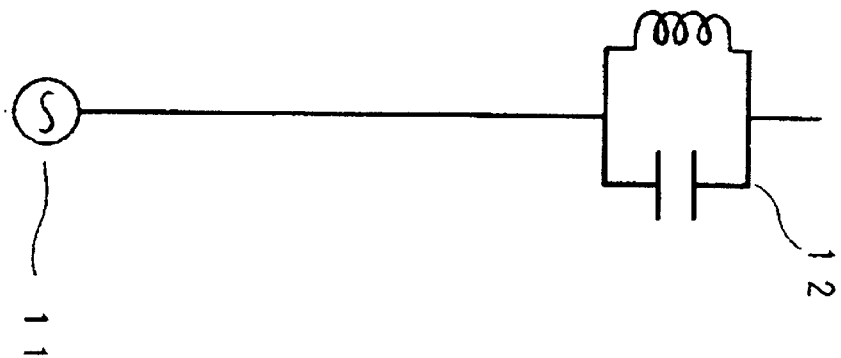
FIG. 6B is an equivalent circuit diagram of the helical antenna of the first embodiment.

An equivalent circuit of helical antenna 2 according to the first embodiment will be described with reference to FIGS. 6A and 6B. FIG. 6A shows a schematic view of helical antenna 2, and FIG. 6B shows the equivalent circuit thereof.

In helical antenna 2, wide pitch portion 7 at the lower side from pitch changing portion 6 and narrow pitch portion 8 at the upper side from pitch changing portion 6 each constitute a rod antenna. Tip end stab element 10 is extended from the upper end of narrow pitch portion 8 and is folded back inside the winding of narrow pitch portion 8 to overlap narrow pitch portion 8. The tail end of tip end stab element 10 is in the vicinity of pitch changing portion 6.

Figure 1:
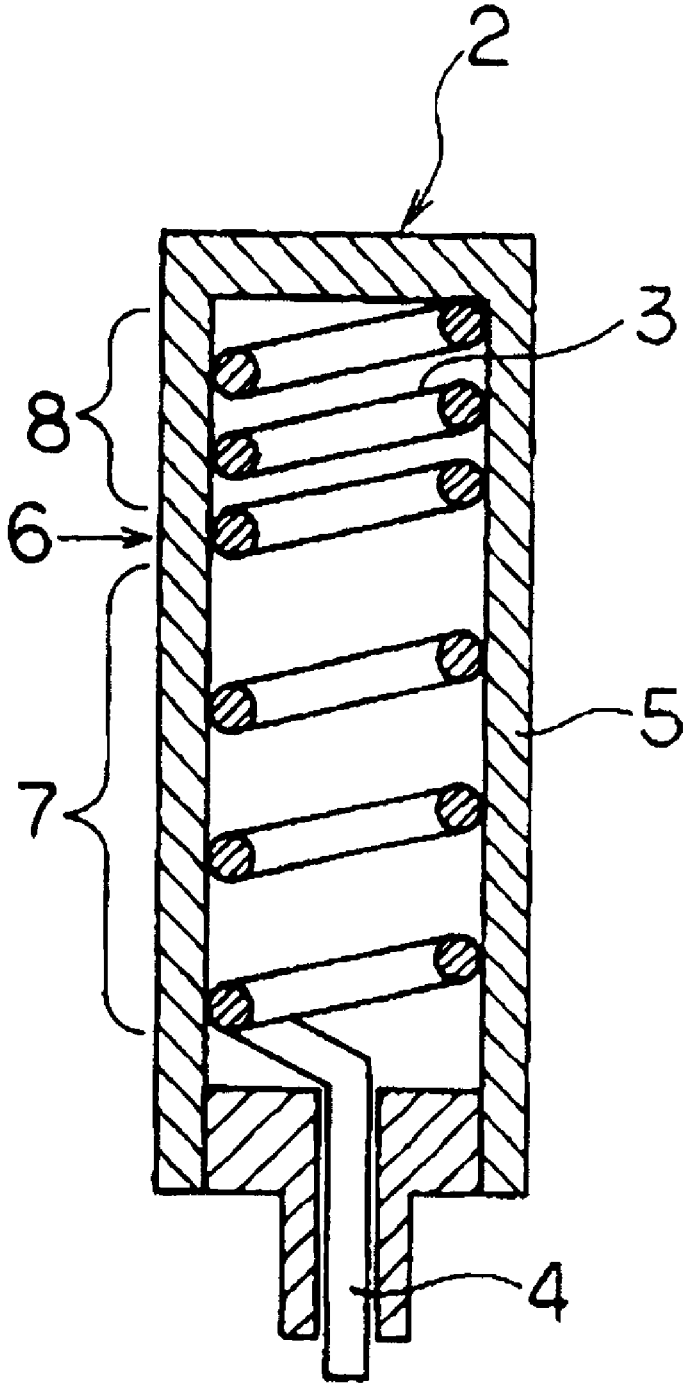
FIG. 1 (BACKGROUND ART)
FIG. 1 is a sectional view of a conventional helical antenna.
Figure 2A:
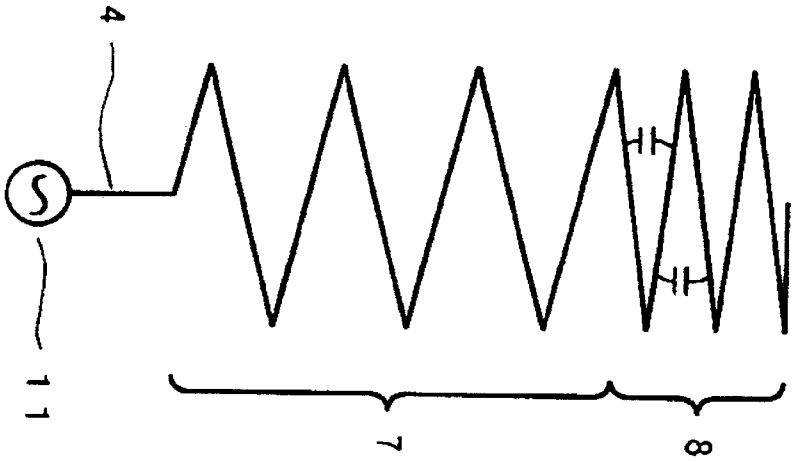
FIG. 2A (BACKGROUND ART)
FIG. 2A is a schematic view of the conventional helical antenna shown in FIG. 1.
Figure 2B:
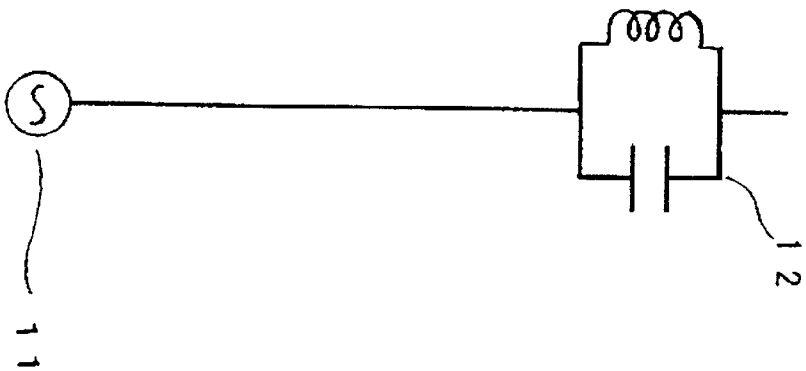
FIG. 2B (BACKGROUND ART)
FIG. 2B is an equivalent circuit diagram of the conventional helical antenna shown in FIG. 1.
Figure 3:
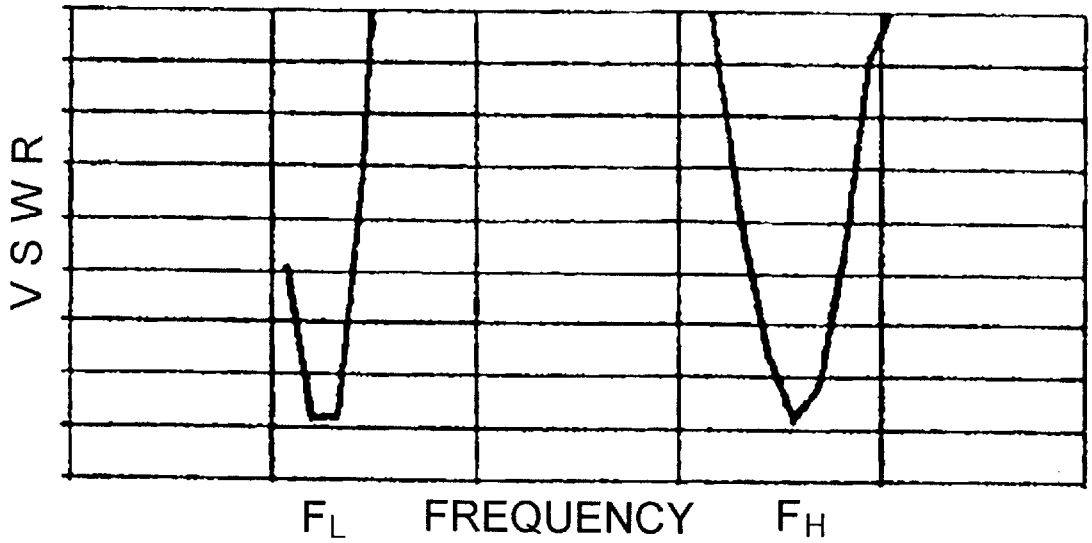
FIG. 3 (BACKGROUND ART)
FIG. 3 is a characteristic diagram of the conventional helical antenna shown in FIG. 1.

Since tip end stab element 10 and conductive wire 3 constituting the winding at narrow pitch portion 8 are placed in close proximity, a capacitance component as shown in FIG. 6A occurs between tip end stab element 10 and narrow pitch portion 8. Since the capacitance component is in parallel with an inductance component by the winding wire at narrow pitch portion 8, a parallel resonant circuit 12 is formed near pitch changing portion 6 as the equivalent circuit of the conventional antenna as shown in FIG. 2, and a trap for selectively passing or blocking a specified frequency is formed. Specifically, parallel resonant circuit 12 has the characteristic that the impedance rises at the resonance frequency, and therefore it prevents passage of a signal near the resonance frequency. On the other hand, the impedance becomes low at the frequencies other than the resonance frequency, and therefore the signals other than those near the resonance frequency can pass.

Parallel resonant circuit 12 is tuned at the second resonance frequency ($f_H$). Thus, parallel resonant circuit 12 has high impedance at the second resonance frequency ($f_H$), and since only wide pitch portion 7 at the lower side from pitch changing portion 6 functions as the antenna, it resonates at wide pitch portion 7 at the lower side from pitch changing portion 6. On the other hand, parallel resonant circuit 12 has low impedance at the first resonance frequency ($f_L$) lower than the second resonance frequency ($f_H$), both wide pitch portion 7 and narrow pitch portion 8 co-operate to function as the antenna, and resonance occurs in the total length of wide pitch portion 7 and narrow pitch portion 8. By the operation of parallel resonant circuit 12 formed near pitch changing portion 6 as described above, helical antenna 2 is tuned to two frequencies ($f_L$, $f_H$).

In this situation, the capacitor constituting parallel resonant circuit (trap) 12 is formed between tip end stab element 10 and the winding wire at narrow pitch portion 8, and unless the positional relationship of tip end stab element 10 and winding wire portion 8, specifically, the diameter of the coil (winding) at narrow pitch portion 8 and the position of tip end stab element 10 are changed, the resonance frequency of parallel resonant circuit 12 does not change. On the other hand, the winding pitch at narrow pitch portion 8 has less influence on capacitance of the capacitor of parallel resonant circuit 12, and the capacitance can be adjusted exclusively with the length of tip end stab element 10. Thus, the winding pitch at narrow pitch portion 8 can be changed without changing the capacitance of the capacitor of parallel resonant circuit 12.

Figure 7:
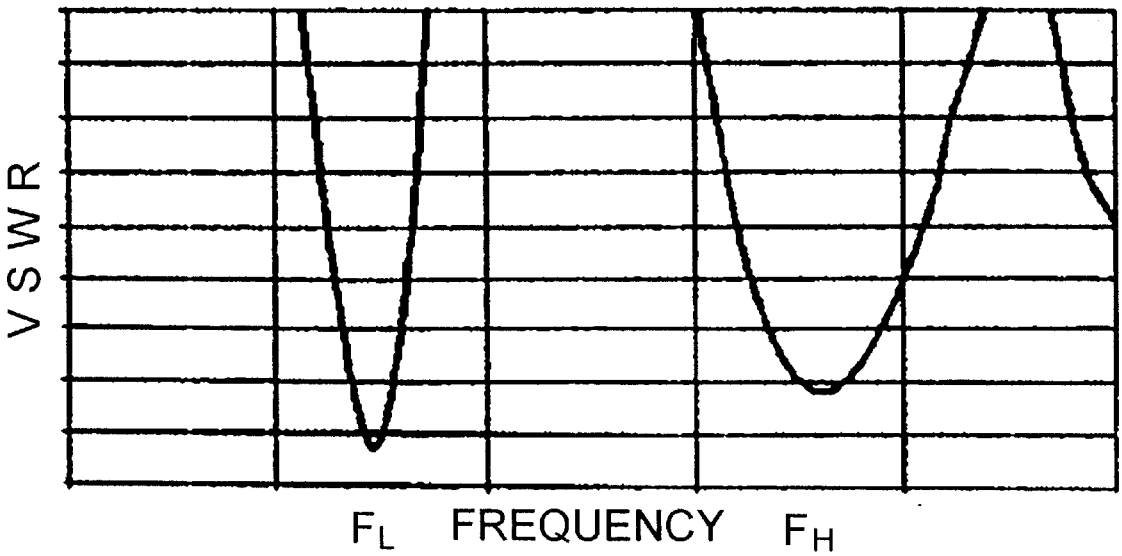
FIG. 7 is a characteristic diagram of the helical antenna of the first embodiment.

FIG. 7 is a diagram showing the frequency characteristic of helical antenna 2 of the first embodiment. In FIG. 7, the vertical axis shows a voltage standing wave ratio (VSWR), and the horizontal axis shows frequency. As shown in FIG. 7, helical antenna 2 has resonance frequencies at which the VSWR becomes low in the vicinity of 900 MHz ($f_L$) and in the vicinity of 1800 MHz ($f_H$), which makes transmission-reception operation possible at two of the frequencies. The VSWR near the first resonance frequency ($f_L$) becomes lower than the conventional helical antenna shown in FIG. 2, and the antenna characteristics near the first resonance frequency ($f_L$) is improved.

In the aforementioned first embodiment, tip end stab element 10 is placed at the center portion of the coil of helical antenna 2, but as in a second embodiment described later, tip end stab element 10 may be placed outside helical antenna 2 in close proximity of the elements, and the capacitor may be formed between the element and tip end stab element 10. Specifically, tip end stab element 10 is placed at the outer perimeter of helical antenna 2 in which conductive wire 3 is wound around to form coil-like elements, and the capacitor is formed between tip end stab element 10 and conductive wire 3 at narrow pitch portion 8 in close proximity thereto.

As described above, in helical antenna 2 of the first embodiment, the antenna element is constituted by first pitch portion (wide pitch portion) 7 at which conductive wire 3 is wound around at a wide pitch, and second pitch portion (narrow pitch portion) 8 at which conductive wire 3 is wound around at a narrow pitch, and tip end stab element 10 extended from the tip end of narrow pitch portion 8 is placed inside the winding at narrow pitch portion 8 in close proximity to narrow pitch portion 8. Second pitch portion is connected to first pitch portion 7 at pitch changing portion 6. Namely, since tip end stab element 10 extended from the top portion of the antenna element is placed in close proximity of narrow pitch portion 8, a capacitance component can be formed between narrow pitch portion 8 and tip end stab element 10 to form parallel resonant circuit 12 at an intermediate portion of the element. As a result, the winding pitch of narrow pitch portion 8 can be changed without changing the capacitance of the capacitor constituting parallel resonant circuit 12, and degree of freedom for the electrical design of the antenna at the first resonance frequency ($f_L$) is increased, thus making it possible to improve the antenna characteristics such as VSWR, band width, radiation efficiency and the like at the first resonance frequency ($f_L$), Since tip end stab element 10 is placed inside narrow pitch portion 8, tip end stab element 10 does not protrude outside the winding, and the antenna can be reduced in size.

Figure 8:
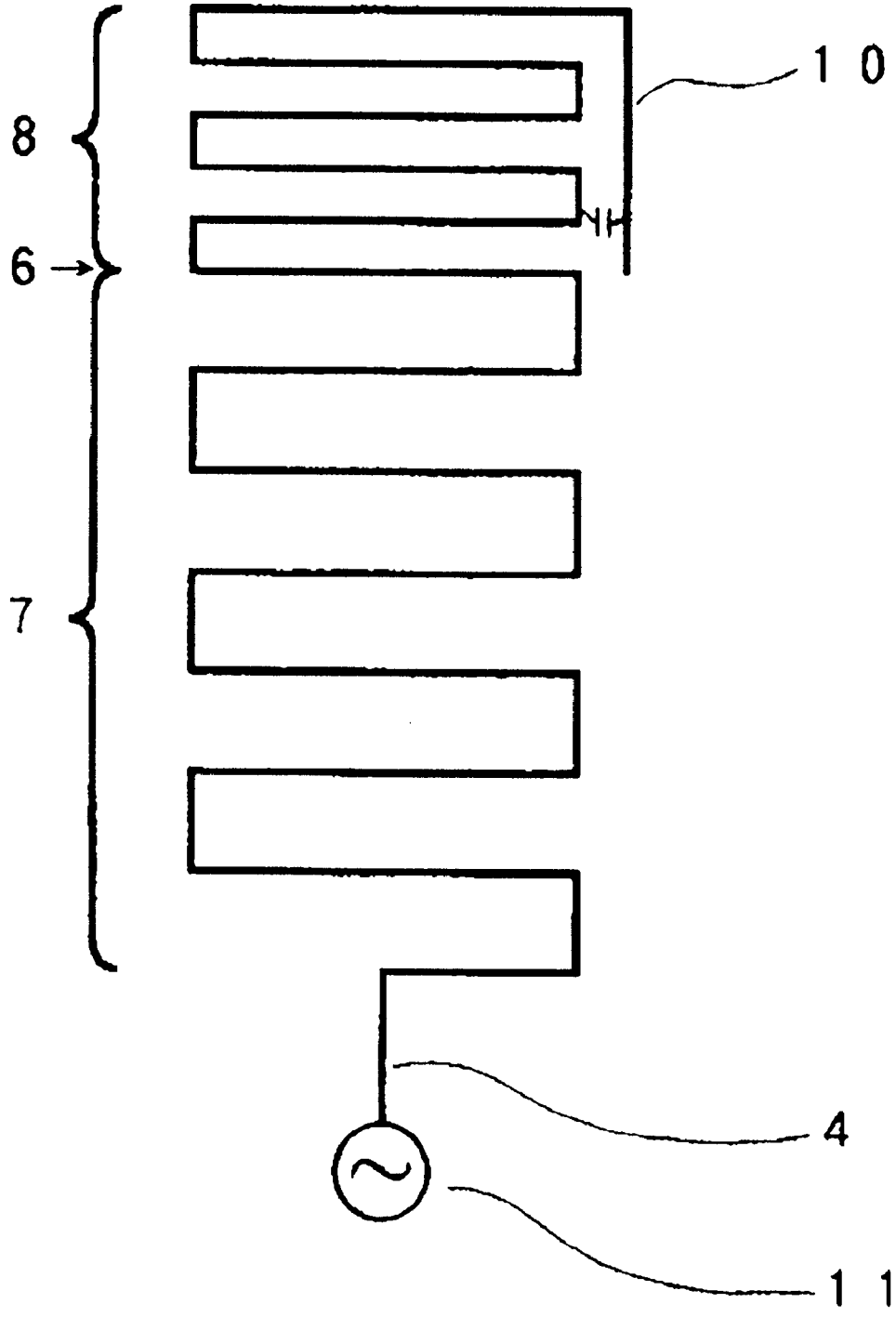
FIG. 8 is a plan view of a helical antenna according to a second embodiment of the present invention.

Helical antenna 2 of the second embodiment shown in FIG. 8 is a helical antenna called a zigzag antenna (meander antenna), which is constructed by folding a rod antenna back at different pitches on a plane and placing the tip end stab element 10 at a region in close proximity to elements 7 and 8 thus folded back. Helical antenna 2 is constituted by conductive wire 3 formed on a substrate (for example, a printed wiring board) contained in a housing of a portable radio apparatus. The tail end of conductive wire 3 forms feeding wire 4, which is connected to the transmission-reception portion of the portable radio apparatus. Conductive wire 3 at the side of feeding wire 4 is folded back in a rectangular (zigzag) shape at a predetermined first pitch, and with the folded-back pitch being changed at pitch changing portion 6, conductive wire 3 is folded back in the rectangular (zigzag) shape at a second pitch narrower than the first pitch. Thus, folded-back conductive wire 3 constitutes wide pitch portion 7 at the lower side from pitch changing portion 6 and narrow pitch portion 8 at the upper side from pitch changing portion 6.

Further, tip end stab element 10 is extended from the top portion of narrow pitch portion 8. Tip end stab element 10 is folded back to the lower side, that is, in the direction of narrow pitch portion 8, and is extended near pitch changing portion 6 at the position in close proximity of conductive wire 3 of narrow pitch portion 8. When the antenna element and tip end stab element 10 are placed as above, a capacitor can be formed between tip end stab element 10 and the antenna element, and a trap by parallel resonant circuit 12 can be composed.

In the aforementioned helical antenna of the second embodiment, tip end stab element 10 is formed on the same plane as elements 7 and 8, but tip end stab element 10 can be formed on a different plane. In concrete, the antenna element is constructed by continuously placing rectangular pattern on one plane of the printed wiring board, and the pattern is extended via a through-hole from the tip end of the elements to the back side. Tip end stab element 10 is constructed on the back surface of the printed wiring board at the position in which it overlaps the rectangular pattern of the front surface by being extended in the direction of feeding wire 4.

In the aforementioned first and second embodiment, tip end stab element 10 is extended from the tip end of the antenna element, but it may be extended from an intermediate portion of the antenna element, which means in concrete that the element may be branched from the intermediate point (for example, the first turn from the upper end) of narrow pitch portion 8 and tip end stab element 10 may be extended to a portion near pitch changing portion 6.

Further, in the aforementioned first and second embodiment, a metal plate in a circular or polygonal form and the like may be attached to the tip end of tip end stab element 10, or the tip end may be folded back (for example, folded at 90 degrees). As a result of placing the tip end of tip end stab element 10 in close proximity of conductive wire 3 at the position which does not contact conductive wire 3 composing the element, the distance between tip end stab element 10 and conductive wire 3 of the antenna element is adjusted to change the capacitance of the capacitor formed between the element and tip end stab element 10, whereby the resonance frequency of parallel resonant circuit 12 can be changed.

As described above, in the second embodiment, the antenna element is constituted by first pitch portion (wide pitch portion) 7 at which conductive wire 3 is folded back at a wide pitch and second pitch portion (narrow pitch portion) 8 at which conductive wire 3 is folded back at a narrow pitch and which connects to first pitch portion 7, and tip end stab element 10 extended from the tip end of narrow pitch portion 8 is placed adjacently to narrow pitch portion 8. Namely, since tip end stab element 10 extended from the top portion of the antenna element is placed in close proximity of narrow pitch portion 8, a capacitor (capacitance component) is formed between narrow pitch portion 8 and tip end stab element 10, and parallel resonant circuit 12 can be formed at an intermediate portion of the antenna element. As a result, the folded-back pitch at narrow pitch portion 8 can be changed without greatly changing the capacitance of the capacitor, which is formed between narrow pitch portion 8 and tip end stab element 10 to determine the resonance frequency of parallel resonant circuit 12, thus facilitating to improve the antenna characteristics at the first resonance frequency ($f_L$).

Figure 9:
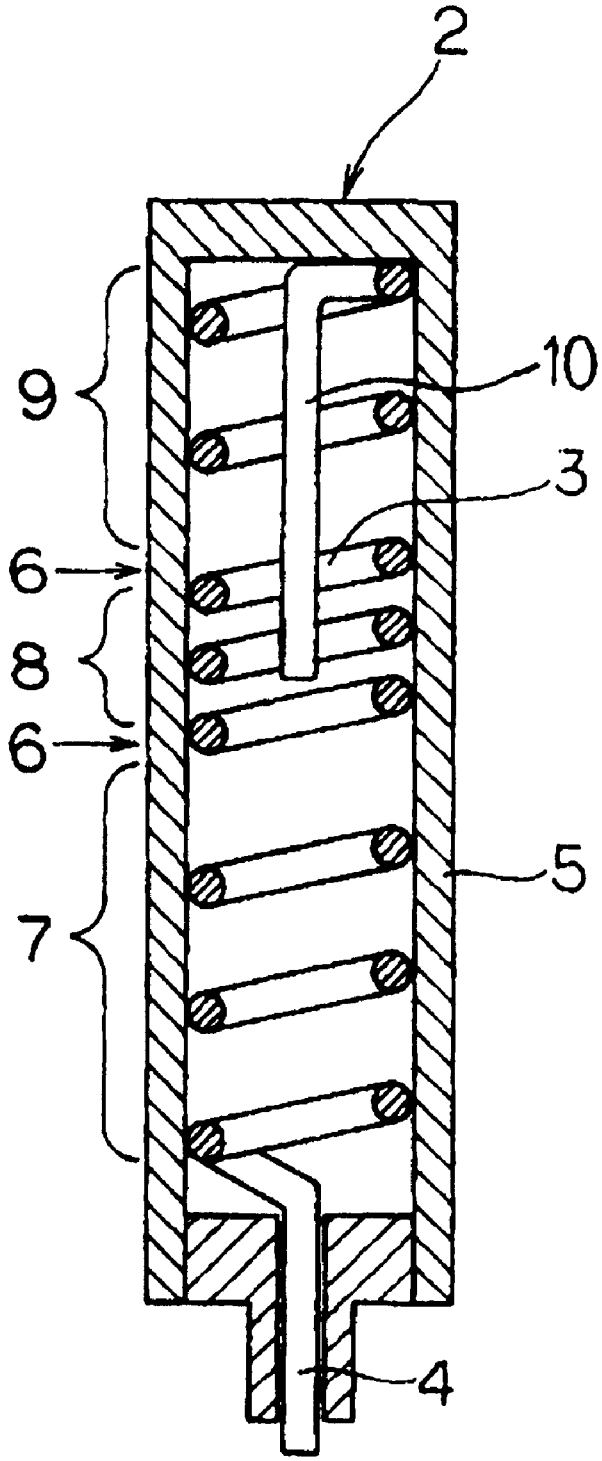
FIG. 9 is a sectional view of a helical antenna according to a third embodiment of the present invention.

Helical antenna 2 of the third embodiment shown in FIG. 9 is constructed by connecting in series the elements composed of three windings with different pitches, which are, from the feeding point side, wide pitch portion 7, narrow pitch portion 8, and wide pitch portion 9, vertically placing them, and hanging tip end stab element 10. Tip end stab element 10 is extended from the tip end of the winding wire in a center portion of the winding and placed at a position in close proximity of the winding. The other constitutions are the same as in the first embodiment explained in FIG. 5, and therefore the detailed explanation of the individual constitutions given the same reference numerals and having the same functions as those therein will be omitted.

In helical antenna 2, conductive wire 3 wound around is housed in case 5, and the tail end of conductive wire 3 is drawn from the lower end of case 5 as feeding wire 4. In case 5, conductive wire 3 is wound around at a predetermined first winding pitch and at pitch changing portion 6, it is wound around at a second winging pitch with the winding pitch being changed to the second winding pitch narrower than the first winding pitch. Further, conductive wire 3 is wound around at a third winding pitch wider than the second winding pitch at the upper portion of the second pitch portion. Consequently, the winding wire pitch is converted at two pitch changing portions 6, and conductive wire 3 thus wound around forms first pitch portion (wide pitch portion) 7 at the lower side, second pitch portion (narrow pitch portion) 8 in the middle, and third pitch portion (wide pitch portion) 9 at the upper side. The winding pitch of third pitch portion 9 may be the same as the winding pitch of first pitch portion 7, or it may be suitable if it is wider than the winding pitch of second pitch portion 8.

In the third embodiment, parallel resonant circuit 12 is constructed by connecting a capacitor formed between the adjacent winding wires at narrow pitch portion 8 and an inductance by the winding wire in parallel. Since the resonance frequency of this parallel resonant circuit 12 is the second resonance frequency ($f_H$), parallel resonant circuit 12 has high impedance at the second resonance frequency ($f_H$) and resonates at wide pitch portion (first pitch portion) 7 at the lower side from narrow pitch portion 8. On the other hand, at the first resonance frequency ($f_L$), parallel resonant circuit 12 has a low impedance, and all of two wide pitch portions 7 and 9 and narrow pitch portion 8 function as an antenna element, and resonance occurs in the total length. As described above, the antenna tuning to two frequencies ($f_L$, $f_H$) is constructed by the operation of parallel resonant circuit 12 formed at narrow pitch portion 8.

In the third embodiment shown in FIG. 9, tip end stab element 10 is extended from the upper end of wide pitch portion (the third pitch portion) 9 at the further upper side. In this situation, the tip end of tip end stab element 10 is extended to an area near narrow pitch portion 8 to supplement the capacitance of the capacitor of parallel resonant circuit 12 formed at narrow pitch portion 8.

As the antenna to which the third embodiment of the present invention is applied, the concrete constitution of an example of the helical antenna operable in both bands of 900 MHz and 1800 MHz will be explained below. Wide pitch portion (the third pitch portion) 9, which is located near the tip end of the antenna, is constructed by about one winding turn at a winding pitch of about 4.5 mm (about 0.013 times to the wavelength of the first resonance frequency ($f_L$)), narrow pitch portion (second pitch portion) 8 located between wide pitch portions 9 and 7 is constructed by about one and half turns at a winding pitch of about 1 mm (about 0.003 times to the wavelength of the first resonance frequency ($f_L$)), and wide pitch portion (first pitch portion) 7 is by about three turns at a winding pitch of about 4 mm (about 0.012 times to the wavelength of the resonance frequency ($f_L$)). Tip end stab element 10 is folded back in the center direction of the winding from the tip end of the antenna and extended by about 6 mm inside the winding.

In the helical antenna of the third embodiment, the characteristics of the antenna at the first resonance frequency ($f_L$) can be also changed without changing the characteristics of parallel resonant circuit 12. Namely, if the winding pitch and the number of winding turns of second pitch portion (narrow pitch portion) 8 are not changed, the resonance frequency of parallel resonant circuit 12, and therefore, by freely changing the number of winding turns, the winding pitch and the like of wide pitch portions (the first pitch portion 7, third pitch portion 9), the characteristics of the antenna can be changed at the first resonance frequency and the second resonance frequency independently of the resonance frequency of the parallel resonant circuit 12. Thus, the antenna characteristic can be improved at the first resonance frequency ($f_L$). In concrete, by widening the winding pitch of third pitch portion (wide pitch portion) 9, usable frequency at the first resonance frequency ($f_L$) is band-widened, and the VSWR at this frequency band is reduced, thus improving radiation efficiency.

As described above, the third embodiment is constructed by first pitch portion (wide pitch portion) 7 at which conductive wire 3 is wound around at a wide pitch, second pitch portion (narrow pitch portion) 8 at which conductive wire 3 is wound around at a narrow pitch, and third pitch portion (wide pitch portion) 9 at which conductive wire 3 is wound around at a pitch wider than the winding pitch of second pitch portion 8, and therefore the capacitance component is formed between the adjacent winding wires at narrow pitch portion 8, thus making it possible to form parallel resonant circuit 12 at narrow pitch portion 8. Thus, even if the winding pitches of wide pitch portions 7 and 9 are changed, it never happens that the capacitance of the capacitor that determines the resonance frequency of parallel resonant circuit 12 greatly changes, and therefore it becomes easy to improve the antenna characteristics of the resonance frequency ($f_L$) at the lower side.

While a preferred embodiment of the present invention has been described using specific terms, such description is for illustrative purposes only, and it is to be understood that changes and variations may be made without departing from the spirit or scope of the following claims.

What is claimed is:

1. A helical antenna comprising:

a radiation element which is formed by helically winding an electric conductor, said radiation element consisting of a first pitch portion in which said electric conductor is wound around at a first winding pitch and a second pitch portion in which said electric conductor is wound around at a second winding pitch different from said first winding pitch; and a tip end element which is extended from a tip end of said radiation element, wherein said first pitch portion is connected to a feeding point, and said second pitch portion is connected to said first pitch portion and said tip end element, and wherein said tip end element is folded back into a helix of said electric conductor and placed inside a winding of said second pitch portion.

2. A helical antenna according to claim 1, wherein said first winding pitch is larger than said second winding pitch.

3. A helical antenna according to claim 1, wherein said radiation element and said tip end element form frequency selection means at an intermediate portion of said radiation element.

4. A helical antenna according to claim 3, said frequency selection means comprising a parallel resonant circuit.

5. A helical antenna according to claim 4, wherein said first winding pitch is larger than said second winding pitch.

6. A helical antenna according to claim 1, wherein said tip end element is not extended to a portion corresponding to said first pitch portion.

7. A helical antenna comprising:

a radiation element which is formed by helically winding an electric conductor;

said radiation element consisting of a first pitch portion which said electric conductor is wound around at a first winding pitch, a second pitch portion in which said electric conductor is wound around at a second winding pitch narrower than said first pitch, and a third pitch portion in which said electric conductor is wound around at a third winding pitch wider than said second winding pitch; and a tip end element which is extended from a tip end of said radiation element, wherein said first pitch portion is connected to a feeding point, said second pitch portion is connected to said first pitch portion, and said third pitch portion is connected to said second pitch portion and said tip end element, and wherein said tip end element is folded back into a helix of said electric conductor, placed inside a winding of said electric conductor, and extended to a portion corresponding to said second pitch portion.

8. A helical antenna according to claim 7, wherein said second pitch portion and said tip end element form frequency selection means at an intermediate portion of the radiation element.

9. A helical antenna according to claim 8, said frequency selection means comprising a parallel resonant circuit.

10. A helical antenna according to claim 7, wherein said tip end element is not extended to a portion corresponding to said first pitch portion.

* * * * *